US006450375B1

(12) United States Patent
Hins et al.

(10) Patent No.: US 6,450,375 B1
(45) Date of Patent: Sep. 17, 2002

(54) SLOTTED CLOSING VALVE FOR OPENINGS OF CONTAINERS

(75) Inventors: Johannes Hins, Sundern (DE); Timothy I. Gabbard; Mark Gabbard, both of Salesbury, MD (US)

(73) Assignee: Georg Menshen GmbH & Co. KG, Finnentrop (DE)

( * ) Notice: Subject to any disclaimer, the term of this patent is extended or adjusted under 35 U.S.C. 154(b) by 0 days.

(21) Appl. No.: 09/743,034

(22) PCT Filed: May 2, 2000

(86) PCT No.: PCT/EP00/03909

§ 371 (c)(1),
(2), (4) Date: Jul. 17, 2001

(87) PCT Pub. No.: WO00/66447

PCT Pub. Date: Nov. 9, 2000

(30) Foreign Application Priority Data

May 4, 1999 (DE) ..... 299 07 933 U

(51) Int. Cl.[7] ..... B65D 25/40
(52) U.S. Cl. ..... 222/491; 222/484; 222/490
(58) Field of Search ..... 222/484, 490, 222/491

(56) References Cited

U.S. PATENT DOCUMENTS

| | | | | |
|---|---|---|---|---|
| 3,556,122 A | * | 1/1971 | Laerdal | 137/102 |
| 3,822,720 A | | 7/1974 | Souza | |
| 4,139,124 A | * | 2/1979 | Ferrante | 222/110 |
| 5,005,737 A | * | 4/1991 | Rohr | 222/212 |
| 5,301,707 A | | 4/1994 | Remko | |
| 5,492,253 A | * | 2/1996 | Proshan | 222/547 |

FOREIGN PATENT DOCUMENTS

| | | |
|---|---|---|
| EP | 0419420 | 2/1990 |
| EP | 0743259 | 5/1996 |
| GB | 2324297 | 10/1998 |

* cited by examiner

*Primary Examiner*—Henry C. Yuen
*Assistant Examiner*—Melvin A. Cartagena
(74) *Attorney, Agent, or Firm*—Birch, Stewart, Kolasch & Birch, LLP

(57) ABSTRACT

A slit closure valve for container openings includes a membrane member of flexible material having an at least unidirectionally aligned slit-like outlet opening and a base member peripherally surrounding the membrane member and connected to the membrane member. The outlet opening is held in its closed position by the resilient properties of the material although it is adapted to be moved into its open position against the resilient bias force of the material by a predetermined differential positive pressure exerted on one side of the membrane member. A peripheral wall portion of the base member and an adjacent wall portion of the membrane member include therebetween an acute angle of less than 90'. At least one further, substantially peripherally aligned slit-like passage opening held in its closed position by the resilient properties of the material is provided in the membrane wall portion near the base member, said passage opening being adapted to be moved into its unblocking position by a differential negative pressure exerted on the membrane member from the side thereof subjected to said predetermined differential positive pressure. The valve thereby enables the pressure between the interior of a container and its surroundings to be equalized thus assisting in the restoration of the container after its walls have been pressed-in manually for emptying the contents of the container.

5 Claims, 1 Drawing Sheet

SLOTTED CLOSING VALVE FOR OPENINGS OF CONTAINERS

This application is the national phase under 35 U.S.C. §371 of PCT International Application No. PCT/EP00/03909 which has an International filing date of May 2, 2000, which designated the United States of America.

BACKGROUND OF THE INVENTION

The invention relates to a slit closure valve for container openings or the like. The invention especially relates to self-closing and self-opening valves for installation in an opening of a container or for completing a closure cap.

A one-piece slit closure valve, which can be produced in a single operational step by a two component injection moulding process using different thermoplastic plastics materials is known (c.f. e.g. EP-A-0 743 259). The substantial manufacturing advantages attained hereby are however countered by the fact that the restoration to its original configuration of a container provided with such a valve, after the container has been compressed so as to exert pressure on the contents of the container, is frequently incomplete, or, only occurs after a long period of time since the pressure between the interior of the container and its surroundings cannot equalise. Thus various alternative designs of self-closing valves incorporating a pressure equalising function have already been proposed (c.f. e.g. DE-U-298 17 571, 298 18 414). A specially designed and arranged closure element for closing an outlet opening which has no slit is necessary for performing the pressure equalising function. The advantage of such a specific pressure equalising arrangement is thereby obtained at the expense of a valve which is less convenient to manufacture.

Hence, there is an object of the invention to provide a slit closure valve of the type described hereinabove which has a pressure equalising function and, at the same time, is of simple construction. It is another object of the invention to provide a slit closure valve of the type described hereinabove which can be formed, ready for use, in a single operational step.

SUMMARY OF THE INVENTION

The above objects and other objects of the invention which will become apparent hereinafter are achieved by a slit closure valve including a membrane member of flexible material having an at least unidirectionally aligned slit-like outlet opening, and a base member peripherally surrounding the membrane member. The base member is connected to the membrane member and said outlet opening held in a closed position by the resilient properties of the material and adapted to be moved into an open position against the resilient bias force of the material by a predetermined differential positive pressure exerted on one side of the membrane member. A peripheral wall portion of the base member and an ad acent wall portion of the membrane member include therebetween an acute angle of less than 90', and at least one further substantially peripherally aligned slit-like passage opening held in a closed position by the resilient properties of the material is provided in the membrane wall portion near the base member. The passage opening can be moved into a releasing position by a differential negative pressure exerted on the membrane member from the side subjected to said predetermined differential positive pressure.

Accordingly, the slit closure valve is constructed such that a wall portion of a membrane member is connected to a base member at an acute angle. One or more slit-like passage openings are provided in the area of the joint section. The purpose of these passage openings is to produce an equalisation of the pressure by enabling the surrounding air to enter into the interior of the container when negative pressure conditions exist therein. By contrast, the slit-like passage openings are kept closed when there is an positive pressure in the interior of the container so that this positive pressure can only be expressed by releasing the slit-like outlet opening at an e.g. central portion of the membrane member. The slit closure valve of the invention is of particularly simple and uncomplicated construction and it can be manufactured economically together with said openings in a single operational step e.g. by injection moulding. An embodiment of the slit closure valve lending further assistance to the manufacturing process whilst simultaneously improving the above-mentioned functions provides for the membrane member to have a peak-roofed configuration. Further embodiments of the invention are mentioned in the claims.

DESCRIPTION OF THE PREFERRED EMBODIMENT

Figure 1:
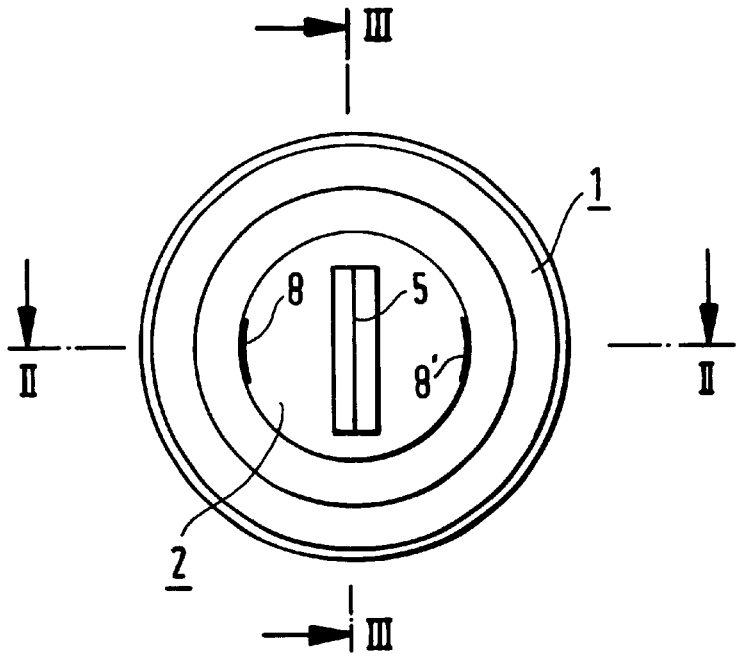
FIG. 1 shows a top view of a slit closure valve constructed in accordance with the invention.

The slit closure valve in accordance with the invention comprises a base member bearing the general reference number 1 and a membrane member bearing the general reference number 2. The base member 1 has an annular configuration and serves for mounting the slit closure valve in an opening that needs to be closed of a container or a closure cap or the like. The membrane member 2 is formed integrally with the base member 1 at a suitable intermediate portion between the axial ends of the base member 1 and preferably near one axial end of the base member 1 such as is indicated by 7, and it preferably has a substantially peak-roofed configuration as can be appreciated especially from FIG. 2. Accordingly, the membrane member 2 comprises side wall portions 3, 3' which are inclined inwardly at an angle a relative to an inner peripheral surface 6 of the base member 1 that may be concentric with the central axis of the slit closure valve. In addition, the membrane member 2 has a central ridge portion 4 which is preferably located in a radial plane relative to the central longitudinal axis. A slit-like outlet opening 5 is formed in the ridge portion 4. In the present embodiment, the slit-like outlet opening 5 extends unidirectionally along one transverse main axis of the slit closure valve, although, if so desired, provision may be made for the slit-like outlet opening to be aligned in some other direction. Moreover, the slit-like outlet opening 5 could be made multidirectional by extending it e.g. along both transverse main axes of the slit closure valve.

FIG. 1 shows the slit-like outlet opening 5 in its closed position which is adopted in the rest prosition of the slit closure valve due to the inherent resilient properties of the material from which the slit closure valve is made. The preferred materials are rubber-like resilient materials such as elastomers, silicon materials or natural or synthetic rubbers and the like. In the case of elastomers, thermoplastic elastomers are preferred because of the ease with which they can be handled in an injection moulding process.

Figure 2:
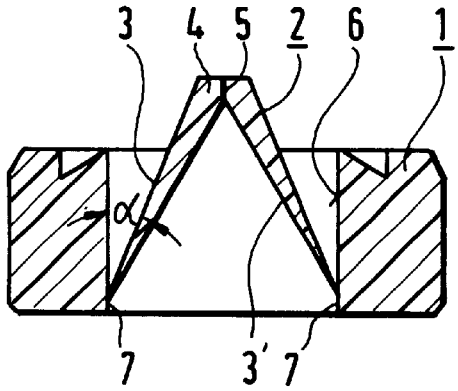
FIG. 2 shows a section along the section line 11—11 in FIG. 1.
Figure 3:
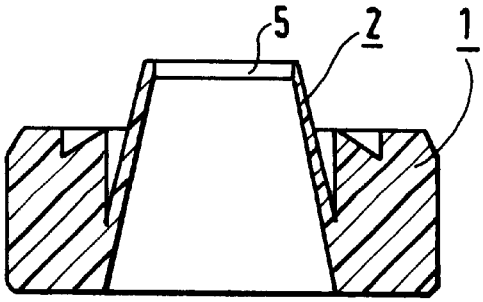
FIG. 3 shows a section along the section line 111—111 in FIG. 1.

It can be appreciated from FIG. 2, that the thickness of the side wall portions 3, 3' tapers from the ridge portion 4 towards the joint section 7 and creates a sealing lip-type structure near the joint section 7.

In accordance with the invention, a respective slit-like passage opening is formed in the side wall portions 3, 3' at diametrically opposed positions of the ridge portion 4 as is indicated by the references 8, 8' in FIG. 1. Each passage opening 8, 8' is aligned unidirectionally peripherally of the membrane member 2 and is a slit which is held in its closed position in the rest position of the slit closure valve due to the inherent resilient properties of the flexible material from which the side wall portions 3, 3' are made. It should be understood that the number and arrangement of the slit-like passage openings 8, 8' is not restricted to the previously described embodiment depicted in FIG. 1. Rather, provision may be made for less or more than two slit-like passage openings 8, 8', and furthermore, the angular spacing between adjacent slit-like passage openings could be something other than diametrical.

The slit closure valve constructed as previously described functions as follows. When the valve is mounted on a (not shown) container in fluid tight manner by e.g. pressing it into an opening in the container such as to seal it, each one of the slit-like openings 5 and 8 are in their closed positions and retain these positions for as long as there are no external forces exerted on the slit closure valve. If, whilst in this starting position, a squeezing force is applied to the container such as to compress the container walls to a certain extent, then the positive pressure occurring in the interior of the container exerts a force on the membrane member 2 which results in the slit-like outlet opening 5 being spread apart. The contents of the container can then be expelled externally through the slit-like outlet opening 5 for as long as the positive pressure is effective. As soon as the squeezing force on the container has been removed and the interior of the container has thus returned to its pressure-less state, the slit-like outlet opening 5 returns to its closed position due to the resilient restorative properties of the flexible material and the interior of the container is thereby hermetically sealed from the exterior.

When the interior of the container is in its unpresserized state or is subject to a low positive pressure, the contents of the container cannot escape outwardly through the slit-like passage openings 8, 8' since, in these circumstances, the passage openings 8, 8' remain closed due to the fact that the sealing lip type end sections of the side wall portions 3, 3' are pressed in sealed manner against the adjacent peripheral surface 6 of the base member 1. The peak-roofed configuration of the membrane member 2 assists this process of closing the passage openings 8, 8', and also that of releasing the slit-like outlet opening 5, by virtue of the side wall portions 3, 3' being rotated outwardly about their points of connection 7 to the base member 1 in the presence of positive pressure.

In the course of the restoration of the compressed container after the external squeezing force has been removed, a partial vacuum occurs in the interior of the container which would prevent complete restoration if pressure equalisation with the outer atmosphere could not occur. The slit-like passage openings 8, 8' effect this pressure equalisation process by virtue of the tendency of the side wall portions 3, 3' of the membrane member 2 to be drawn inwardly away from the peripheral surface 6 of the base member 1 under low pressure conditions. Air can thereby flow into the: interior of the container from its surroundings until the pressure has been equalized. As soon as this state has been adopted once more, the passage openings 8, 8' are reclosed due to the inherent resilient properties of the flexible material from which the side wall portions 3, 3' are made.

Although, if so desired, each of the openings 5, 8 could be formed in an additional operational step following the basic formation of the slit closure valve, it is prefer-red that these openings be formed concurrently with the formation of the slit closure valve. This can be achieved, as the product is being removed from the mould, by moving cutting elements into the material at appropriate parts of an injection moulding tool corresponding to the locations of the openings 5, 8 so as to make cuts therein, these cutting elements then being simultaneously used for performing an ejection operation upon further advancement thereof. Furthermore, a dimensioning of the slit closure valve and a choice of materials is preferably such that the holding force for the outlet opening 5 will be of sufficient strength as to prevent it from being moved into its open position by virtue of a pressure exerted by the head of the contents of the container, thereby such an opening action only occurring when an external force is exerted on the container such as to create an positive pressure in the interior of the container which is greater than the pressure exerted by the head. A container provided with this slit closure valve could therefore be overturned without spilling the contents of the container. Finally, the membrane member need not be in the form of a peaked roof. Rather, some other suitable dome-shaped configuration could be adopted subject to that this would enable the membrane member to be connected to the base member such that the angle a is maintained at less than 900 at least in the vicinity of the passage openings.

What is claimed is:

1. A slit closure valve, including a membrane member made of a flexible material and having a first slit opening, said first slit opening being held in a closed configuration by resilient properties of the flexible material and placed into an open configuration against the resilient properties of the flexible material by a predetermined differential positive pressure being exerted on one of opposite sides of the membrane member, and further including a base member peripherally surrounding the membrane member, said base and membrane members being integrally formed as one piece of material, with said membrane member including a ridge portion in which said first slit opening is provided and a pair of inclined side wall portions extending from said ridge portion to a peripheral wall portion of the base member at acute angles of less than 90° between said peripheral wall portion and said inclined side wall portions, wherein said membrane member defines a second slit opening formed in at least one of said inclined side wall portions at a location near the peripheral wall portion, said second opening being held in a closed position by the resilient properties of the flexible material of said inclined wall portion but being placed into a releasing position by a differential negative pressure exerted on the membrane member from the same side thereof as was subjected to said predetermined differential positive pressure.

2. The slit closure valve according to claim 1, wherein said at least one of said inclined side wall portions of the membrane member near the peripheral wall portion of the base member is formed as a sealing lip of the second slit opening held in sealing engagement with said peripheral wall portion by the resilient properties of the flexible material for closing said second slit opening in the absence of said differential negative pressure exerted thereon.

3. The slit closure valve according to claim 1, wherein another second slit opening is included so that there is a pair of second slit openings on diametrically opposed positions of the membrane member.

4. The slit closure valve according to claim 1, wherein said membrane member is at least partially accommodated within said peripheral wall portion of the base member.

5. The slit closure valve according to claim 1, wherein each of said first and second slit openings are in a plane essentially parallel to a central longitudinal axis of the slit closure valve.

* * * * *